United States Patent [19]

Ito et al.

[11] Patent Number: 4,897,697

[45] Date of Patent: Jan. 30, 1990

[54] COUNTING SYSTEM FOR USE IN A COPYING MACHINE

[75] Inventors: Masazumi Ito, Toyohashi; Kimihiko Higashio, Toyokawa, both of Japan

[73] Assignee: Minolta Camera Kabushiki Kaisha, Osaka, Japan

[21] Appl. No.: 137,187

[22] Filed: Dec. 23, 1987

[30] Foreign Application Priority Data

Jul. 3, 1987 [JP] Japan ..... 62-167568

[51] Int. Cl.[4] ..... G03G 15/01; G03G 21/00

[52] U.S. Cl. ..... 355/326; 355/200; 355/245

[58] Field of Search ..... 355/3 R, 4, 14 CU, 200, 355/245, 326, 327, 328; 118/645

[56] References Cited

U.S. PATENT DOCUMENTS 4,587,536 5/1986 Saito et al. ..... 355/4 X 4,634,258 1/1987 Tanaka et al. ..... 355/4

FOREIGN PATENT DOCUMENTS 159721 10/1985 European Pat. Off. .

61-203474 9/1986 Japan .

*Primary Examiner*—Fred L. Braun

*Attorney, Agent, or Firm*—Burns, Doane, Swecker & Mathis

[57] ABSTRACT

A copying machine includes first and second developing units, each of which contains different color developer. The copy machine is capable of developing an electrostatic latent image on the surface of a photoconductor through individual or successive operation of the first and second developing units. An arrangement is provided for counting the number of copying operations that each developing unit is subjected to during a single scan of the scanning device. The arrangement increases the count values associated with the first developer unit when the first developer unit is operated individually, and increases the count value associated with the second developer unit when the second developer unit is operated individually. Further, the arrangement increases the count value associated with the first and second developer units when both developer units are operated together.

8 Claims, 16 Drawing Sheets

| toner color | switch SW1 | switch SW2 |
|---|---|---|
| black | ON | ON |
| red | ON | OFF |
| yellow | OFF | ON |
| —— | OFF | OFF |

A : BLACK COPY COUNT VALUE b : RED COPY COUNT VALUE

C : YELLOW COPY COUNT VALUE d : SIMUL TANEOUS COLOR COPY COUNT VALUE

COUNTING SYSTEM FOR USE IN A COPYING MACHINE

BACKGROUND OF THE INVENTION

1. FIELD OF THE INVENTION

The present invention relates to a counting system having one or more counters which is used for a maintenance and a charge calculation of a copying machine.

2. DESCRIPTION OF THE PRIOR ART

There has been provided a counter in a copying machine for counting times of copying operation so as to perform the maintenance of the copying machine such as exchange of a developing unit and to count the charge rent of copying machine on the basis of the count value of the counter.

In the counter system mentioned above, after a toner image is transferred and fixed onto a copying sheet through a copying operation, the counter is increased by 1 at the time of discharging the copying sheet on which the image is fixed. In the conventional counter system it has been known to provide either a total counter which counts the total value of the times of the copying operation and a size counter which counts the number of the copy in every size of the copying sheet.

Besides, there has been previously proposed a copying machine which is capable of color copy in more than two colors in one exposure (referred to as simultaneous color copying machine hereinafter) by Canon Inc. in the Japanese Patent Laid Open (unexamined) No.61-203474, wherein there are provided a plurality of developing units in the copying machine, which are switched during one exposure operation so that a picture with partially different color can be printed on a copying sheet. According to the simultaneous color copying machine mentioned above, it is possible to copy the right and left portions of an original document with different colors and or to copy a specific portion of the original document in a different color so as to emphasize the specific portion. Since such different color copy can be made by executing one time copying operation, there are advantages that the work of setting an original document and of operating the copying machine can be saved and that the time necessary for copying operation can be greatly reduced.

In the simultaneous color a copying machine there is, however, a problem that what and how should be counted for performing the maintenance and charge calculation thereof properly.

SUMMARY OF THE INVENTION

An essential object of the present invention is to provide a copying machine capable of simultaneous color control adopting a counting system for performing the maintenance and the proper charge calculation thereof, comprising a plurality of developing units and a simultaneous color control unit controlling the switching operation of said plural units so as to form an image with plural colors during one time copying operation, wherein the operation times of the respective developing units operated by the control of the simultaneous color control unit are counted.

When the copying operation of the simultaneous color operated by the simultaneous color control unit is selectively executed, the operation times of the respective developing units operated in one copying operation are counted and the counted value thereof is displayed in a proper display unit.

BRIEF DESCRIPTION DRAWINGS

FIG. 1 is a schematic view showing an arrangement of a copying machine in which the present invention is applied, FIG. 2 is a partial enlarged cross sectional view showing peripherals of a photoconductor drum and a developing unit in the copying machine shown in FIG. 1, FIG. 3 is a plan cross sectional view of the developing unit shown in FIG. 2, FIGS. 4 and 6 are cross sectional views showing the operation of the developing unit shown in FIG. 2, FIGS. 5 and 7 front are views respectively showing the operation of a solenoid shown in FIG. 4 or FIG. 6, FIG. 8 is a plan view of the copying machine, FIG. 9 is a partial enlarged front view showing a first lever and a second lever, FIG. 10 is a view showing a relation between the operating condition of a magnet switch and a color of toner contained in the developing unit, FIG. 11 is a plan view of the operation panel used in the copying machine shown in FIG. 1, FIG. 12 is a block diagram showing a control unit used in the copying machine shown in FIG. 1, FIG. 13 is a schematic diagram showing an example of the copying counting values displayed by a magnification/minification rate display unit LED and by a sheet number display unit LED, FIGS. 14 to 16, 17*a*, 17*b*, 18, and 19 are flow charts showing a copying operation of the copying machine shown in FIG. 1, FIG. 17 is a block diagram of FIGS. 17*a* and 17 *b*, FIG. 20 is a timing chart showing an operating condition of the developing unit in the simultaneous color copying operation.

DETAILED DESCRIPTION OF THE PREFERRED EMBODIMENT

Figure 1:
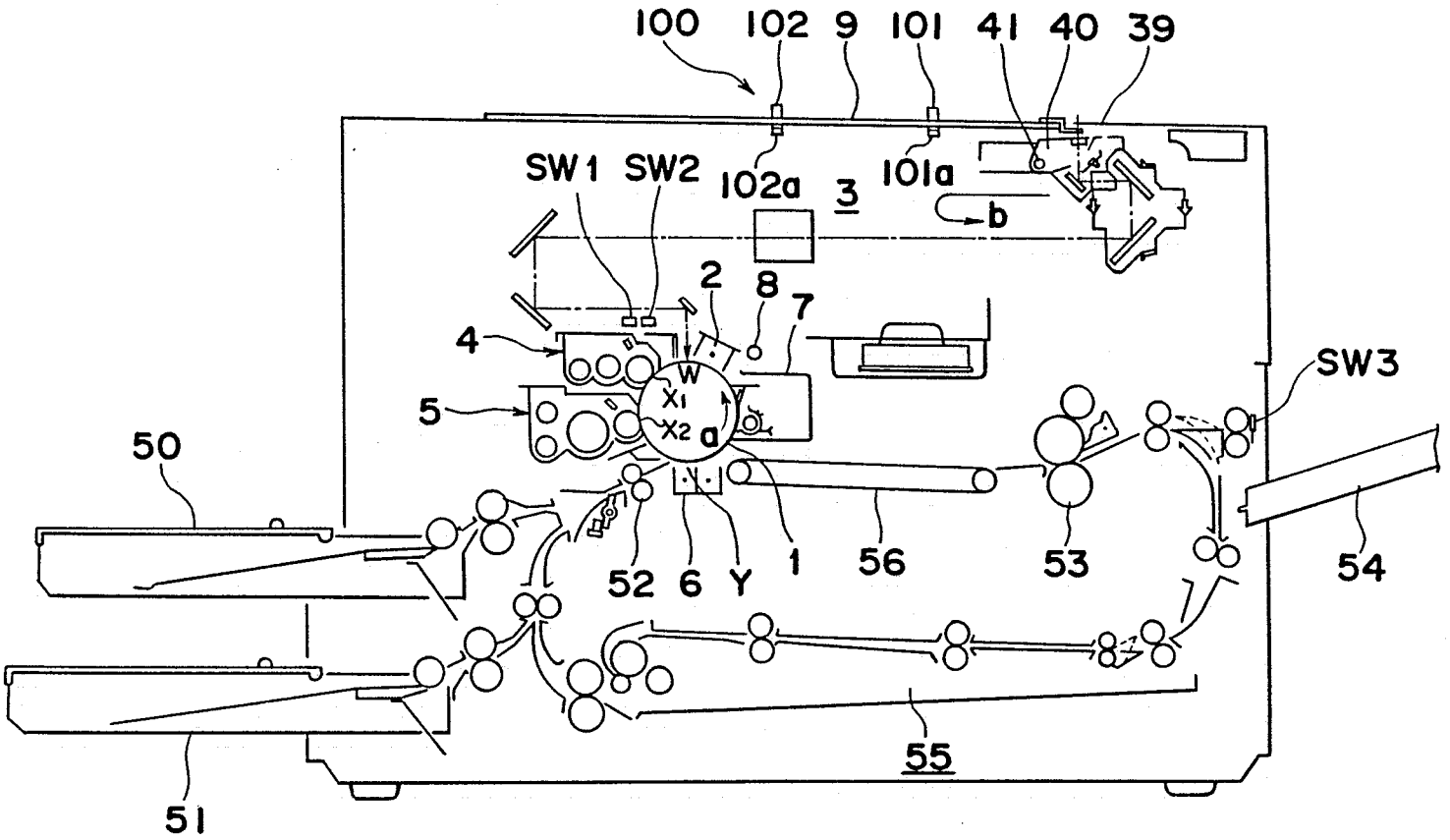

FIG. 1 is a front sectional view showing a schematic structure of a copying machine comprising two developing units. Schematic structure of a copying machine is described with respect to a standard copying operation in which an image of an original document is reproduced as it is. First, under the condition that a photoconductor drum 1 is rotating in a direction shown by an arrow mark a, upon discharging of charger 2, electric charge is applied to the surface of the photoconductor drum 1.

Next, a scanner 40 having an exposure lamp 41 in an optical system 3 is moved in a direction shown by an arrow mark b, radiating light to an original document disposed on a platen 9 made of glass for placing an original document to be copied, and the reflection light thereof is projected onto the surface of the photoconductor drum 1 through an exposure point W via a lens system and various mirrors, whereby an electrostatic latent image corresponding to the image of the original document is formed on the surface of the photoconductor drum 1.

The electrostatic latent image is developed at a developing area X1 or X2 opposing respectively to a first developing unit 4 and second developing unit 5 arranged in turn by supplying toner from the developing unit 4 or 5.

On the other hand, a copying sheet is selectively fed from a sheet feeding device 50 or 51 to a transference area Y opposing to a transfer charger 6 at the same time of forming the toner image on the photoconductor drum 1 through a pair of timing roller 52, where the toner image is transferred to the copying sheet, then the copying sheet to which the image is transferred is fed to the portion between a pair of fixing rollers 53 by means of a carrier belt 56 so that the toner image is fixed on the copying sheet by melting and the copying sheet on which the image is fined is transported to a sheet-discharge device 54.

In case a dual side copying mode is selected, the copying sheet is fed into a duplex device 55 from said fixing rollers 53 and after the copying sheet is turned over in the duplex device 55, the inverted copying sheet is fed into said transference area Y again. On the other hand, in the optical system 3 and the peripheral portion around the photoconductor drum 1, the second copying operation is executed in a similar way mentioned above, so that the toner image is transferred onto an other surface of the copying sheet.

The remaining toner on the surface of the photoconductor drum 1 is cleaned off by a cleaning device 7 and remaining electric charge is erased by the radiation of light of an eraser lamp 8 so that the preparation for forming the next image is made.

In the copying machine mentioned above, there is further provided an image editing device 100. The developing units 4 and 5 and an operation panel 70 (see FIG. 11) are provided with a specific arrangement respectively so that, in addition to the standard copying operation, the simultaneous color control can be operated. In this arrangement, during the period of one time copying operation performed by one time scanning operation of the scanner 40, the image with two colors is formed by operating the two developing units 4 and 5 alternatively.

The first developing unit 4 and the second developing unit 5 are detachably attached to the copying machine, and the first and the second developing units 4 and 5 each containing developer of different color are exchangeable for a same type of a developing unit. In the present embodiment, each of the developing units 4 and 5 is exchangeable for a black developing unit for black color accommodating developer containing black toner and carrier and for a red developing unit for red color accommodating developer containing red toner and carrier, or for a yellow developing unit for yellow color accommodating developer containing yellow toner and carrier.

Therefore, there is a need for a judging means for judging the developing units for which color among black, red and yellow ones are attached to the copying machine as the first and second developing units 4 and 5.

In the present embodiment, the black developing unit is usually attached as the second developing unit 5 and any one of the developing units for black, red and yellow can be attached as the first developing unit 4.

There are two magnet switches SW1 and SW2 at the portion for attaching the first developing unit 4 in the copying machine. On the other hand, there are provided two magnets in the black developing unit, opposing to the switches SW1 and SW2. There is provided a magnet opposing to the switch SW1 in the red developing unit, and there is provided a magnet opposing to the switch SW2 in the yellow developing unit. These magnets are not shown.

Figures 10, 11:
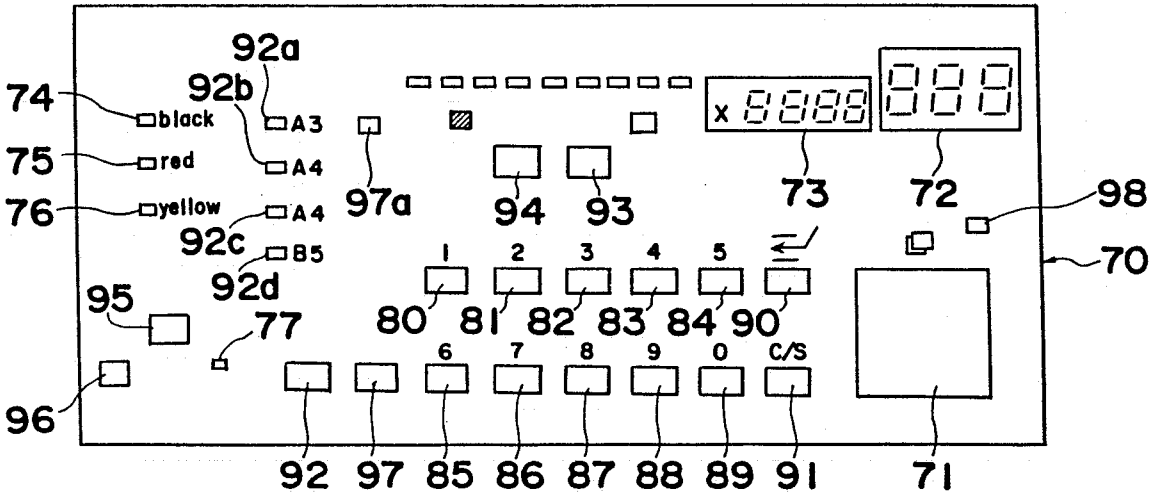

As shown in a color code table in FIG. 10, when the black developing unit is attached as the first developing unit 4, both of the switches SW1 and SW2 are turned on, when the red developing unit is attached as a first developing unit 4, only the switch SW1 is turned on, when the yellow developing unit is attached as the first developing unit 4, only the switch SW2 is turned on. When no developing unit is attached as the first developing unit, both of the switches SW1 and SW2 are turned off. The signals of the switches SW1 and SW2 turned on or off are applied to a control unit.

Figure 2:
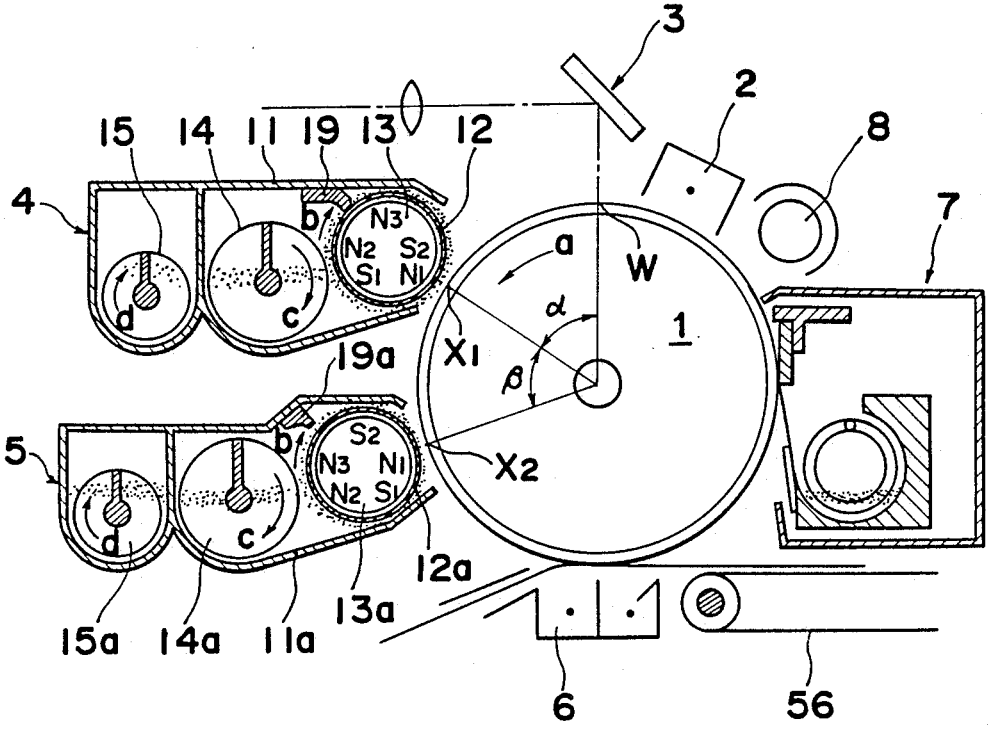

As shown in FIG. 2, the developing units 4 and 5 have generally similar constitution, in a developing vessel 11, there are arranged a developing sleeve 12, a feeding roller 14 and a screw device 15 in the turn from the side of the photoconductor drum 1.

The developing sleeve 12 is made of non-magnetic conductive material formed of cylindrical shape of 24.5 mm diameter with minute uneven patterns formed on the outer cylindrical surface by sand blast processing. The developing sleeve 12 (12*a*) opposes the developing area X1 (X2) of the photoconductor drum 1 with a developing gap of Ds (= 0.6 mm , having rotation angles $\alpha$ , ($\alpha + \beta$ ), from the exposure point W to the developing areas X1, (X2) respectively set, wherein the rotation angle $\alpha$ is made 56° and $\beta$ is made 52°.

Figure 4:
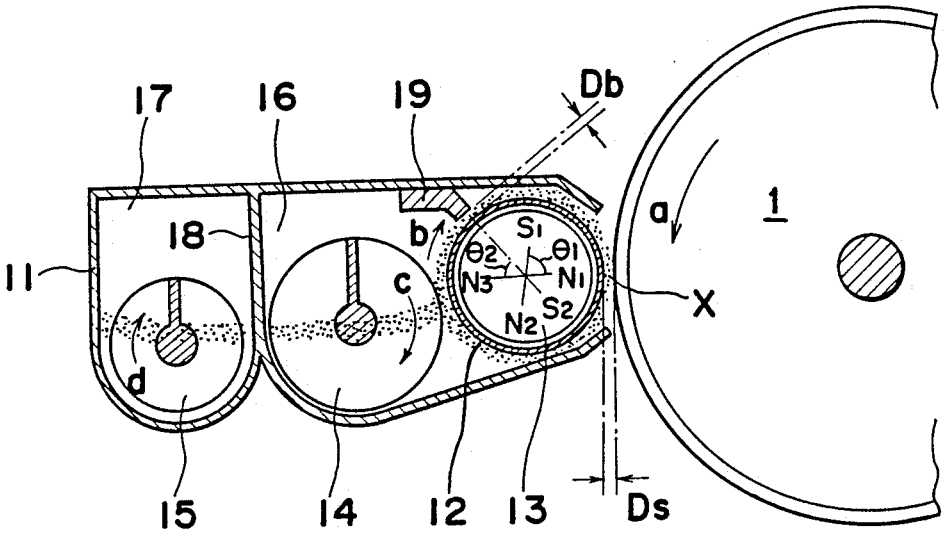

As shown in FIG. 4, in the rear portion of the developing area X of the developing sleeve 12, there is provided a head control member 19 with a head control gap Db of 0.4 mm wide in the upper portion on the inner surface of the developing vessel 11, opposing the surface of the developing sleeve 12.

In the developing sleeve 12, there is provided a magnet roller 13 having a plurality of magnets disposed to extend in the direction of the axis of said magnet roller 13. The magnetic fluxes of the magnet poles $N_1$ to $N_3$, $S_1$ and $S_2$ positioned in the outer surface of the magnets are respectively made as follows;

$N_1$ = 1000 G, $N_2$ and $N_3$ = 500 G, $S_1$ and $S_2$ = 800 G ( herein G: gauss ).

As shown in FIG. 4, the central portion of the magnet pole $N_1$ is situated at the position corresponding to the position rotated $\theta_1$ (=80°) in the clockwise direction from the central portion of the magnet pole $S_1$, and the central portion of the magnet pole $N_3$ is arranged at the position corresponding to the position rotated $\theta_2$ (=40°) in the counter-clockwise direction from the portion opposing to the head control member 19 under the condition that the magnet pole $N_1$ opposes to the photoconductor drum 1.

Figure 3:
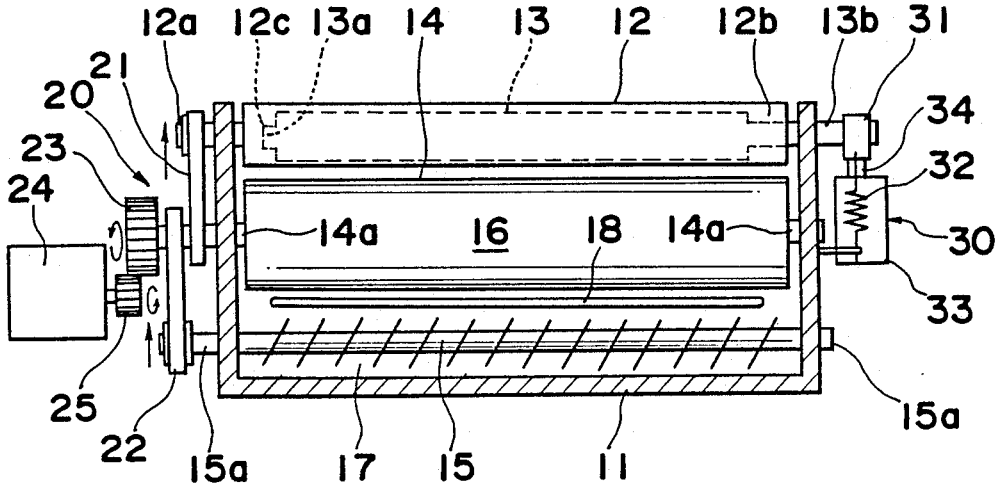

As shown in FIG. 3, one end portion 13*a* of the shaft of the magnet roller 13 is supported at a shaft supporting concave 12*c* formed in the developing sleeve 12 and an other end portion 13*b* of the shaft is supported at a proper portion in the side wall of the developing vessel 11, so that the magnet roller 13 is rotatable by a predetermined angle $\theta_1$ (=40°) by means of a moving unit 30 to be described hereinafter.

On the other hand, a shaft supporting portion 12*b* of the right side of the developing sleeve 12 in FIG. 3 is supported by the shaft 13*b* of the magnet roller 13, and the shaft 12*a* of the left side is supported by the side wall of the developing vessel 11, whereby the developing sleeve 12 is rotatable by means of a driving unit 20.

The feeding roller 14 and the screw device 15 are respectively arranged in carrier paths 16 and 17 which are separated from each other by a partition wall 18, and the shaft 14*a* of the feeding roller 14 and the shaft 15*a* of the screw device 15 are respectively supported by the side walls of the developing vessel 11, whereby the feeding roller 14 and the screw device 15 are rotatable by means of the driving unit 20. The carrier paths 16 and 17 are joined together at both side portions of the developing vessel 11 as shown in FIG. 3.

The driving unit 20 of the developing units 4 and 5, the feeding roller 14 and of the screw device 15 will be explained as follows.

As shown in FIG. 3, the shaft 12*a* of the developing sleeve 12 is connected with the shaft 14*a* of the feeding roller 14 through a belt 21, and the shaft 14*a* of the feeding roller 14 is connected with the shaft 15*a* of the screw device 15 through a belt 22.

There is attached a gear 23 to the left end portion of the shaft 14*a* of the feeding roller 14 and the gear 23 is engaged with a driving gear 25 of a motor 24.

Therefore, when the motor 24 is driven so as to rotate the driving gear 25 in the direction shown by a real line marks shown in FIG. 3, the gear 23 and the belts 21 and 22 are respectively driven in the direction shown by real arrow marks, so that the developing sleeve 12, the feeding roller 14 and the screw device 15 are respectively rotated in the directions shown by arrow marks b, c and d shown in FIG. 4. Herein, the developing sleeve 12 is set to rotate at 240 r.p.m..

Figure 5:
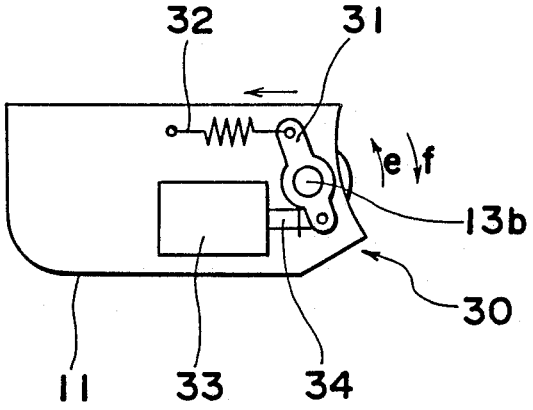
Figure 7:
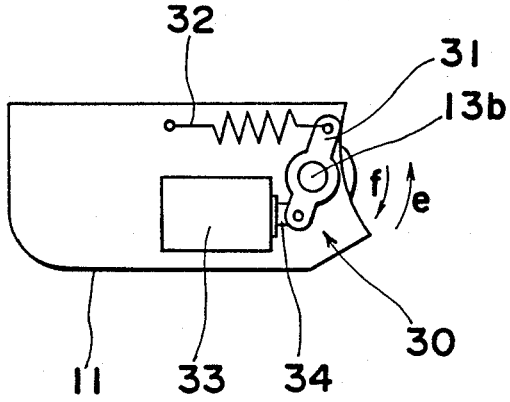

As shown in FIGS. 5 and 7, the driving unit 30 of the magnet roller 13 is composed of a lever 31, a spring 32 and a solenoid 33, and the lever 31 is fixed to the end portion of the shaft 13*b* of the magnet roller 13, and one end portion of the spring 32 fixed to the developing vessel 11 is attached to the upper end portion of the lever 31 so as to be always biased in the direction shown by an arrow mark e. A plunger 34 of the solenoid 33 is engaged with the lower end portion of the lever 31, and when the solenoid 33 is driven, the lever 31 is rotated in the direction shown by an arrow mark f against the applied force of the spring 32.

When the solenoid 33 is not operated, in other words, the lever 31 is settled in the condition shown in FIG. 5, the magnet pole $N_1$ of the magnet roller 13 opposes the photoconductor drum 1, and the magnet pole $N_3$ is. L settled at the position rotated at an angle $\theta_2$ (=40°) in the counter-clockwise direction from the portion opposing to the head control member 19 as shown in FIG. 4.

Figure 6:
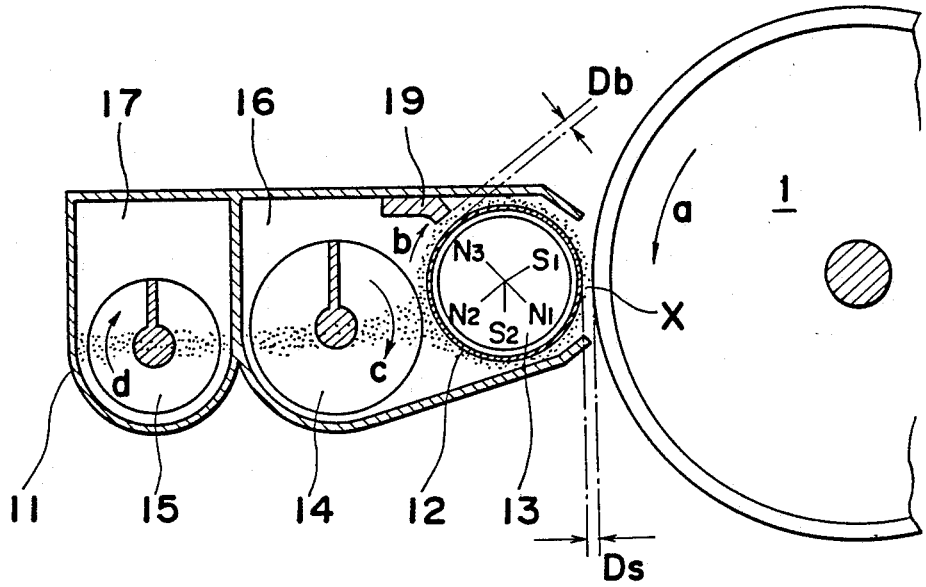

On the contrary, when the solenoid 33 is operated and the lever 31 is settled in the condition shown in FIG. 7, the magnet pole $N_3$ opposes the head control member 19 so that the middle portion between the magnet pole $N_1$ and the magnet pole $S_1$ opposes to the photoconductor drum 1 as shown in FIG. 6.

Figure 8:
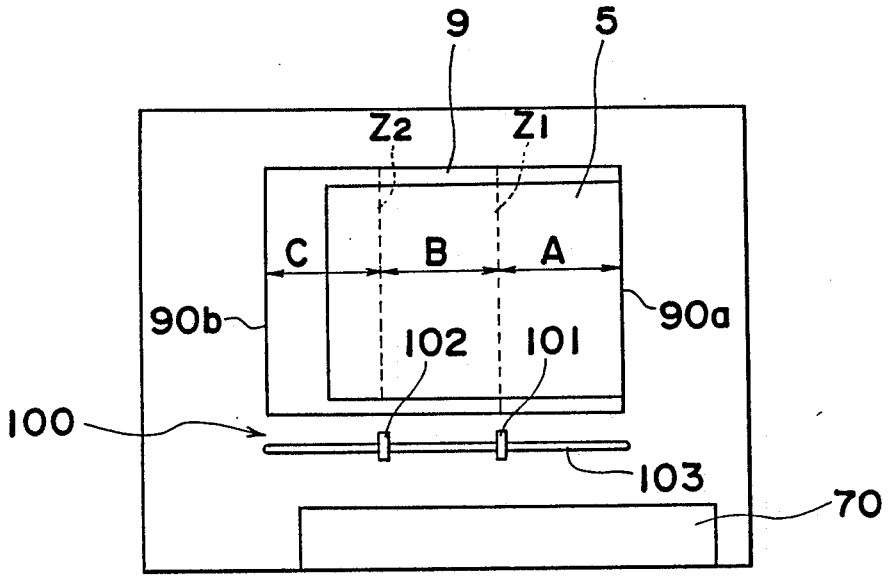
Figure 9:
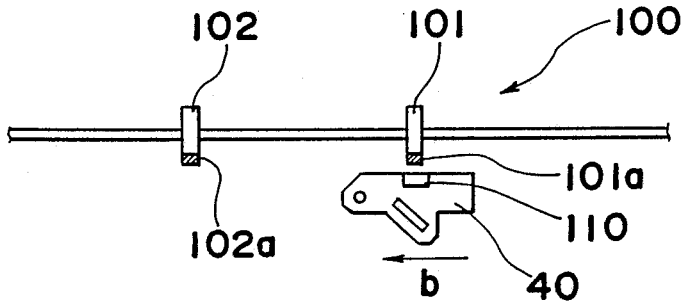

Next, referring to the image editing device 100 with reference to FIGS. 8 and 9, the first lever 101 and second lever 102 divide the original document disposing surface, which is the surface of the platen, in the direction of the motion of the scanner (in the direction shown by the arrow mark b) so as to indicate the developing area and the reproduction color thereof, and the first and second levers 101 and 102 are slidably attached to the guide slot 103 which is formed along the scanning direction of the scanner 40 in the side portion of the platen 9, and there are provided magnets 101*a* and 102*a* respectively at the under portions of the first and second levers 101 and 102 inside the copying machine.

Under the condition that each of the first and second levers 101 and 102 is set as shown in FIG. 8, the area A is indicated from the edge portion 90*a* of the platen 9 to the dotted line $Z_1$ corresponding to the first lever 101 and the area B is indicated from said dotted line $Z_1$ to the dotted line $Z_2$ corresponding to the second lever 102 and the area C is indicated from said dotted line $Z_2$ to the rear edge portion 90*b* of the platen 9, and the areas A and C are indicated as the areas to be copied in black and the area B is indicated as the area to be copied in red or yellow.

Figure 12:
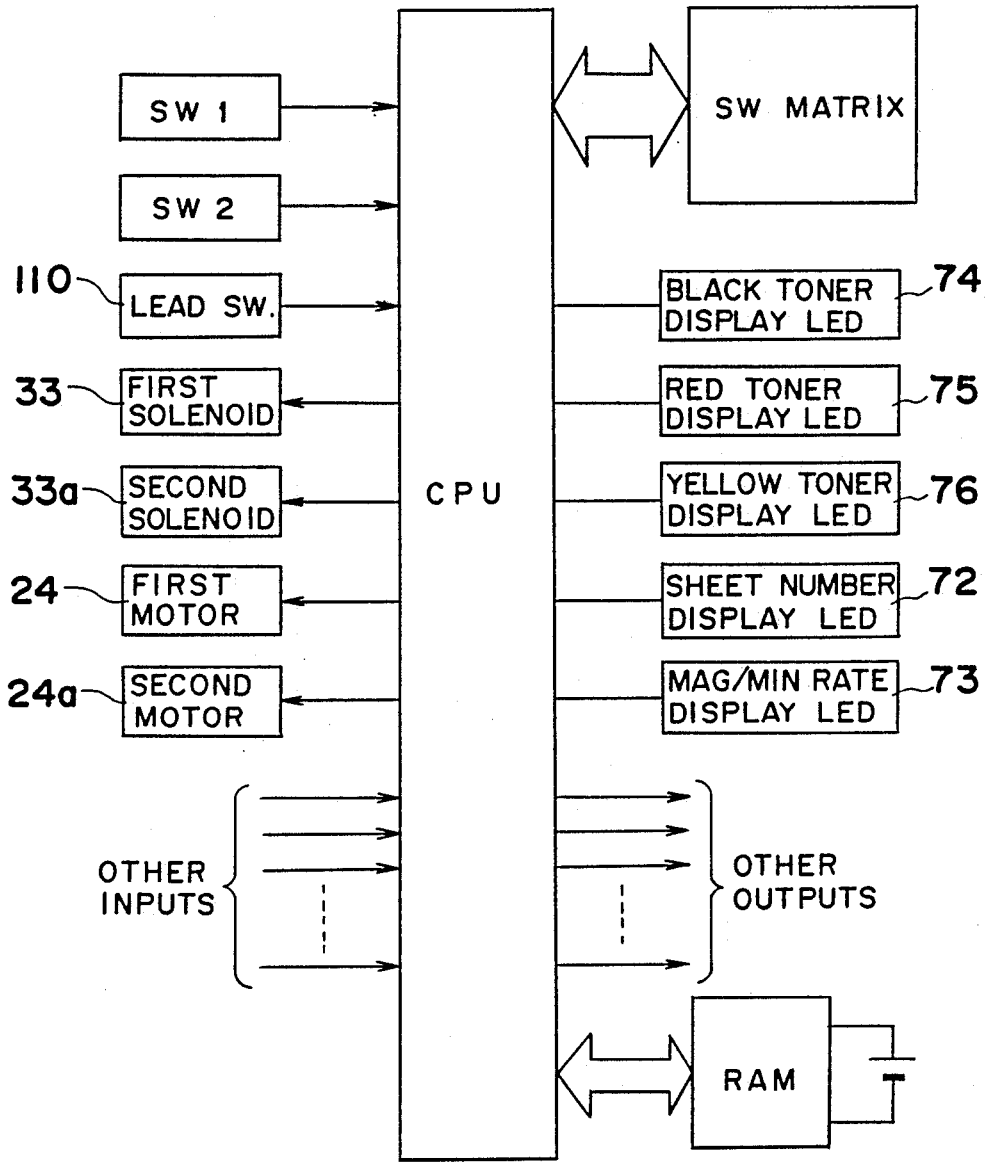

On the other hand, in the scanner 40 of the optical system, there is provided a lead switch 110 for detecting the magnets 101*a* and 102*a* and thereby transfering the signals into a control unit as shown in FIG. 12.

Referring to FIG. 11 showing the operation panel 70 in the copying machine, reference numeral 71 denotes a print key, numeral 72 a sheet number display unit LED for displaying the number of copied sheets, numeral 73 a magnification or minification (referred to as MAG/-MIN) rate display unit LED for displaying the MAG/-MIN rate of the copied image to the original document image, and these display units LED 72 and LED 73 also display the count values of various kinds of the counters to be described later.

Reference numerals 74 to 76 denote toner color display units LED which display respectively black, red and yellow colors. Numeral 77 denotes a toner empty display unit LED for displaying the empty condition of the toner. Numeral 80 to 89 denote ten keys comprising 0 to 9 keys, numeral 90 denotes an interruption key for ordering the interruption of the copying operation, numeral 91 denotes a clear stop key C/S, numeral 92 denotes a sheet selecting key, numerals 92*a* to 92*d* denote sheet size selecting display units LED for displaying the sheet sizes A3, B4, A4 and B5 respectively, numerals 93 and 94 denote respectively an up key and a down key for controlling the density of the image of the copied sheet.

Reference numeral 95 denotes a selection key for selecting the first developing unit 4 and the second developing unit 5, numeral 96 denotes a total check key, numeral 97 denotes a simultaneous color selection key for selecting the simultaneous color, numeral 97*a* denotes a simultaneous color displaying unit LED showing the condition that the simultaneous color mode is selected, numeral 98 denotes an all reset key.

FIG. 12 shows a block diagram of the control unit, wherein the signals of the switches SW1 and SW2 and other signals are inputted to the central processing unit (referred to as the CPU hereinafter). The solenoids 33 and 33*a* of the first and the second developing unit, the first and the second developing unit motors 24 and 24*a*, and various kinds of display units LED 72 to LED 76 are connected to the output terminals of the CPU. In addition, a switch matrix including of the various kinds of key switches on the operation panel 70 and a non volatile RAM (random access memory) are connected to CPU. The non-volatile RAM is partially used by the copying counters for black, red, yellow and simultaneous color copying operations.

Figure 13:
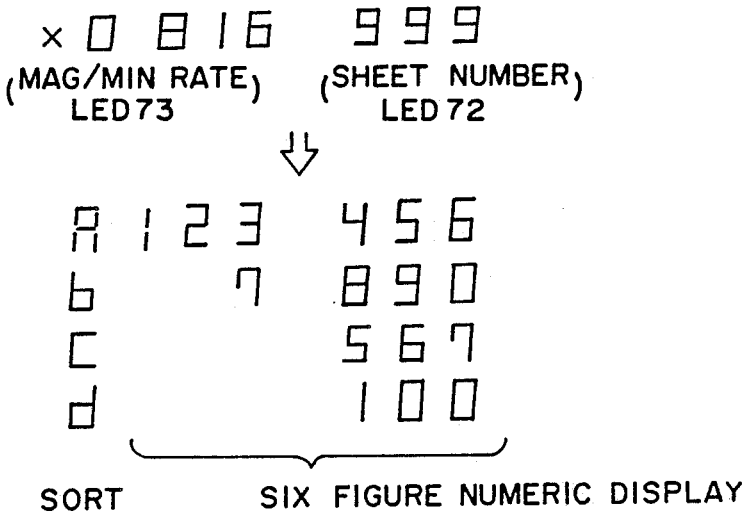

FIG. 13 shows a display example of the count values of the various kinds of the copying counter, which is displayed on the display units LED 72 and LED 73.

As shown in FIG. 13, one of the alphabetic letters 'A', 'b', 'c', and 'd' is displayed on the most significant figure of the four figures of the MAG/MIN rate display unit LED 73 which indicates what sort of count value is to be displayed. The lower three figures of the MAG/-MIN display unit LED 73 and the three figures of the sheets number display unit 72 are integrally used as a serial six figures display unit. The segment type display elements composing the sheets number display unit LED 72 and the MAG/MIN rate display unit LED 73 are driven by means of a known driving circuit (not shown) which is controlled by a central processing unit (referred to as CPU hereinafter).

Figure 20:
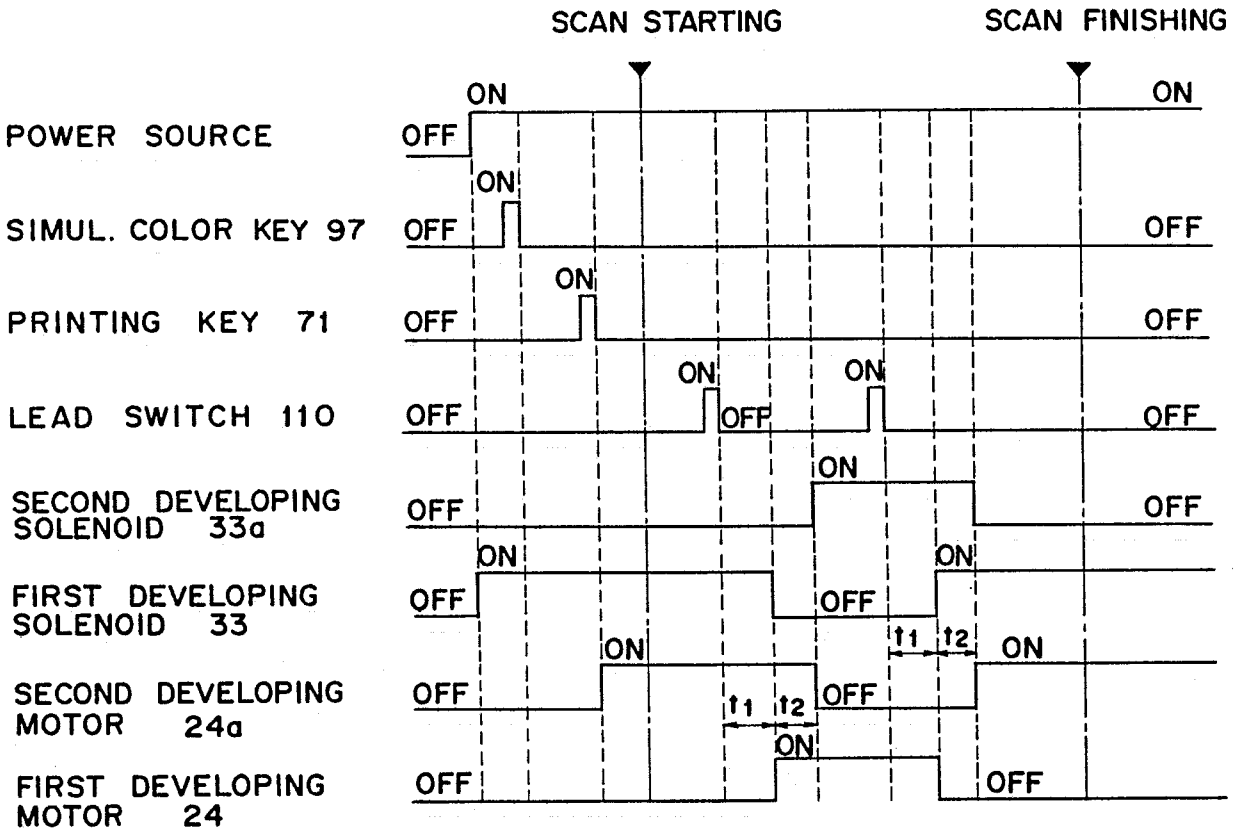

Next, the copying operation in the simultaneous color mode will be explained with reference to a timing chart shown in FIG. 20, wherein the components contained in the second developing unit 5 are distinguished by a character 'a' following to the reference numerals.

First, when a main switch (not shown) of the copying machine is turned on and power is supplied to the copying machine, the middle portion between the magnet pole $N_1$ and the magnet pole $S_1$ in the first developing unit 4 opposes to the portion X1 of the photoconductor drum 1 and the magnet pole $N_1$ in the second developing unit 5 opposes to the portion X2 of the photoconductor drum 1 as shown in FIG. 2.

Under this condition, when the print key 71 is turned on, the second developing unit 5 containing the black toner is automatically driven so as to perform the standard copying operation. When the simultaneous color selection key 97 is turned on, the copying machine is set in the condition capable of performing the simultaneous color copying operation. However, in case the simultaneous color selection key 97 is turned on during the copying operation, the simultaneous color copying operation is not executed.

When the simultaneous color selection key 97 is turned on, the copying mode is changed from the standard copying mode to the simultaneous color copying mode.

Under this condition, the first lever 101 and the second lever 102 are slid along the sliding slot 103, thereby setting the areas A and C of the black copy and setting the area B of the color copying as shown in FIG. 8.

The first and the second levers 101 and 102 are enabled only when the simultaneous color copying mode is set, however, each of the levers 101 and 102 is disabled when the other copying mode is selected.

Under the condition that the simultaneous color copying mode is set as mentioned above, when an original document is placed on the platen 9 and the print key 71 is turned on as shown in FIG. 8, the developing motor 24*a* of the second developing unit 5 is started and the developing sleeve 12*a*, the feeding roller 14*a* and the screw device 15*a* are rotated in the direction shown by the arrow marks b, c and d respectively.

By the operation mentioned above, the developer agent including black toner, which is accommodated in the developing vessel 11*a*, is mixed and stirred by the rotations of the feeding roller 14*a* and the screw device 15*a* and is circularly transported in the carrying paths 16*a* and 17*a*, so that a part of the developer is fed to the surface of the developing sleeve 12*a* through the rotation of the feeding roller 14*a*, whereby magnetic brushes are formed on the surface of the developing sleeve 12*a*.

The thickness of the magnetic brushes are adjusted by passing through the space of the head control gap Db between the head control member 19*a* and the developing sleeve 12*a* by the rotation of the developing sleeve 12*a* so that the the adjusted magnetic brushes are serially fed to the developing area X2, whereby it becomes ready to develop the electrostatic latent image on the surface of the photoconductor drum 1.

Upon turning on the print key 71, the scanner 40 is moved in the direction shown by the arrow mark b in FIG. 1, radiating light onto the original document situated on the platen 9. The reflection light from the original document is radiated onto the surface of the photoconductor drum 1 through the exposure point W, whereby the electrostatic latent image is formed and the development of the electrostatic latent image is made by means of the second developing unit 5 first.

Next, when the signal of the magnet 101*a* of the first lever 101 is detected by the lead switch 110 of the scanner 40 (see FIG. 9), the lead switch 110 applies the signal to the control unit.

At this point, the electrostatic latent image corresponding to the boundary line $Z_l$ between the areas A and B where the copy is changed from the black to the colored (yellow and red) is situated at the exposure point W on the surface of the photoconductor drum 1. In the period of the time $t_1$ (= 0.22 sec.) during which the position of the electrostatic latent image corresponding to the boundary line $Z_1$ is moved from the exposure point W to the developing area X1 of the first developing unit 4, only the second developing unit 5 is continually operated.

When the position of the electrostatic latent image corresponding to the boundary line $Z_1$ reaches the developing area X1 after the lapse of the time $t_1$ from the time of turning on the lead switch 110, the first developing motor 24 is turned on and the solenoid 33 of the first developing unit 4 is turned off.

Thus, in a similar way to the second developing unit 5, the first developing unit 4 is set in the condition as shown in FIGS. 4 and 5, so that the developing sleeve 12, the feeding roller 14 and the screw device 15 are rotated respectively in the directions shown by the arrow marks b, c and d, whereby the magnetic brushes are formed on the surface of the developing sleeve 12 so as to set the condition capable of developing the electrostatic latent image on the surface of the photoconductor drum 1. Then the red or yellow color toner is fed to the electrostatic latent image corresponding to the area B from the first developing unit 4.

Next, after the lapse of the time $t_2$ from the time of starting the first developing motor 24, in other words, after the lapse of the time t (= 0.2 sec.) during which the boundary line $Z_1$ of the electrostatic latent image is moved from the first developing area X1 to the second developing area X2, the motor 24*a* of the second developing unit 5 is turned off and the solenoid 33*a* of the second developing unit 5 is turned on. The second developing unit 5 is set in the condition as shown in FIGS. 6 and 7, so that the middle portion between the magnet pole $N_1$ and the magnet pole $S_1$ opposes to the surface of the photoconductor drum 1 at the portion X and the rotating operations of the developing sleeve 12, the feeding roller 14 and the screw device 15 are stopped so as to finish the developing operation of the area A by using the black toner.

When the scanner 40 is further moved to the boundary line $Z_2$ between the area B and the area C, which is the position corresponding to the second lever 102, the lead switch 110 detects the magnet 102*a* and is turned on again, generating the signal to the control unit. At this time, the electrostatic latent image corresponding to the boundary line $Z_2$ is situated at the exposure point W.

After the lapse of the time $t_1$ from the time of turning on the lead switch 110, in other words, when the position of the electrostatic latent image corresponding to the boundary line $Z_2$ mentioned above reaches to the first developing area X1, the first developing motor 24 is turned off and the solenoid 33 of the first developing unit 4 is turned on so as to finish the red or yellow color development of the area B.

Furthermore, after the lapse of the time $t_2$, in other words, when the position of the electrostatic latent image corresponding to the boundary line $Z_2$ is moved from the first developing area X1 to the second developing area X2, the second developing motor **24*a* is turned on and the second developing solenoid 33*a*** is turned off so as to start the black development of the area C. The developing operation by using the black toner is continued till the scanning operation is finished, so that the black development of the area C is completed.

By the operations mentioned above, the developing color is changed from black to red or yellow and furthermore changed to black in the period from the time of starting the scanning operation to the time of the finishing thereof so that the two color copying development can be obtained.

Next, the control operation of the control unit of the copying machine is explained with reference to flow charts shown in FIGS. 14 to 19.

Figure 14:
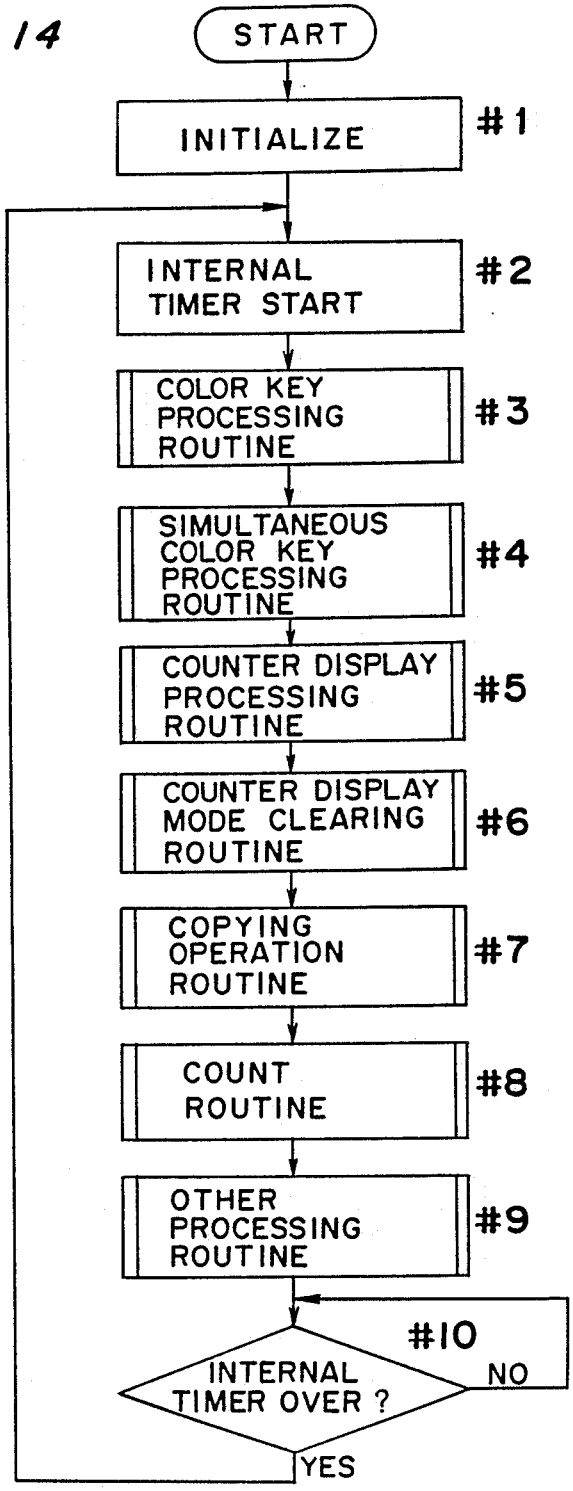

FIG. 14 shows a flow chart of a main routine controlling the whole part of the copying machine.

When the power source of the copying machine is turned on, the CPU in the control unit is initialized and various kinds of modes are set in the standard mode and default values as various kinds of data are set in step #1.

In step #2, the operation of an internal timer for defining a predetermined time for one routine is started. In step #3, a color key processing routine is performed, and in step #4, a simultaneous color processing routine is performed. In step #5, a counter display processing routine for displaying the count values by means of the display units LED 72 and LED 73 is performed.

In step #6, a counter display mode clear routine is performed. In step #7, a copy operating routine is performed and the standard copying operation or the simultaneous color copying operation is performed. In step #8, a count routine counting the time of the operations of each of the developing units 4 and 5 is performed. In step #9, other processing routines are performed, and it is judged next in step #10 whether or not the operation of the internal timer started in the step #2 is finished. In the case the operation of the timer is finished, the program goes back to the step #2 again. In the case the operation of the timer is not finished yet, the program waits.

Figure 15:
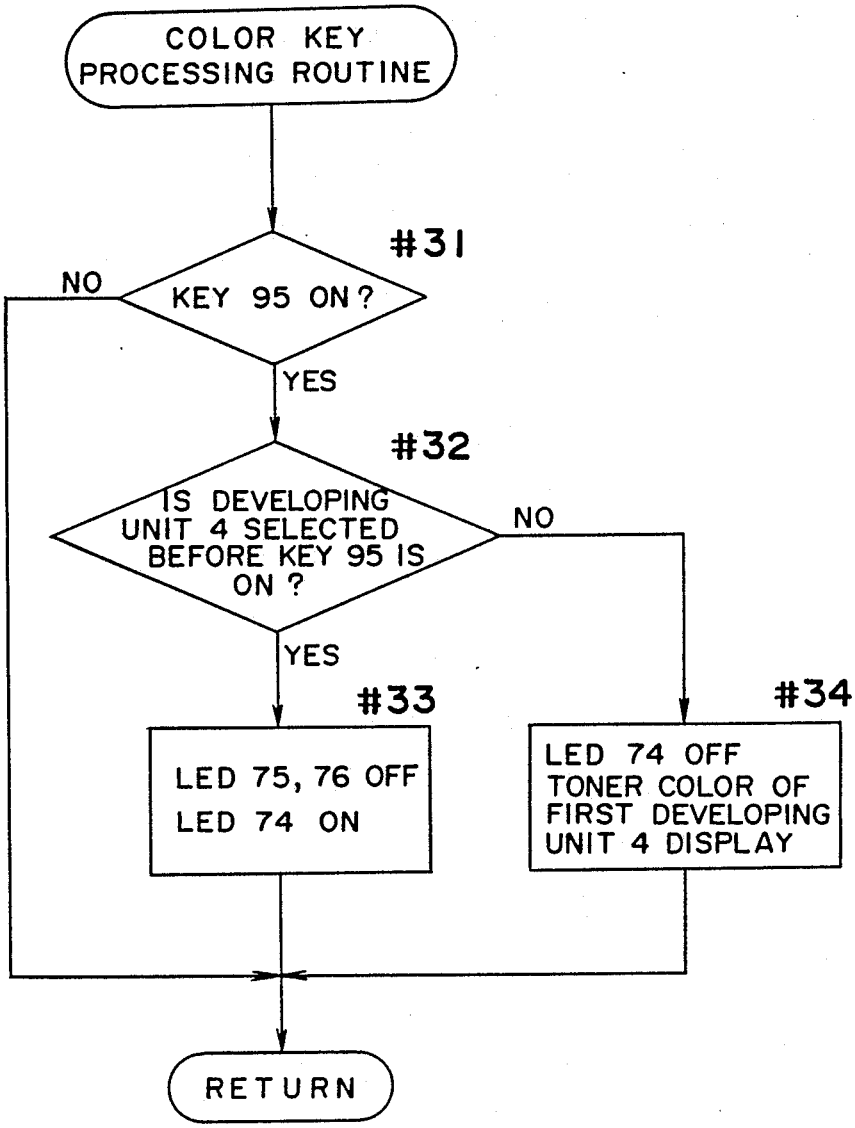

FIG. 15 shows a flow chart showing a color key processing routine.

It is judged in step #31 whether or not the developing unit selecting key 95 is turned on, and in the case the selecting key 95 is not turned on (in the case of 'No'), the program returns, and in the case the selecting key 95 is turned on (in the case of 'Yes'), the program goes to step #32. In the step #32, it is judged whether or not the first developing unit 4 is already selected before the developing unit selecting key 95 is turned on in the step #31. In case of 'Yes', the LED 75 for indicating red toner and LED 76 for indicating yellow toner are both turned off and the display unit 74 for the black toner is turned on in step #33. In case of 'No', the LED corresponding to the toner color contained in the developing unit attached as the first developing unit 4 is turned on in step #34.

The toner color of the first developing unit 4 is judged according to the color code table shown in FIG. 10 on the basis of the 'on'/'off' signal of the switches SW1 and SW2, which is inputted to the control unit.

As described above, in case the selecting key 95 is turned on by executing the color key processing routine on the condition that the LED 74 for displaying black toner is turned on, the LED 75 for indicating red toner or LED 76 for indicating yellow toner, corresponding to the toner color contained in the developing unit attached as the first developing unit 4, is turned on.

On the contrary, in case the selecting key 95 is turned on under the condition that the LED 75 for indicating red toner or LED 76 for indicating yellow toner is turned on, the display unit LED 74 for indicating black toner is turned on.

Figure 16:
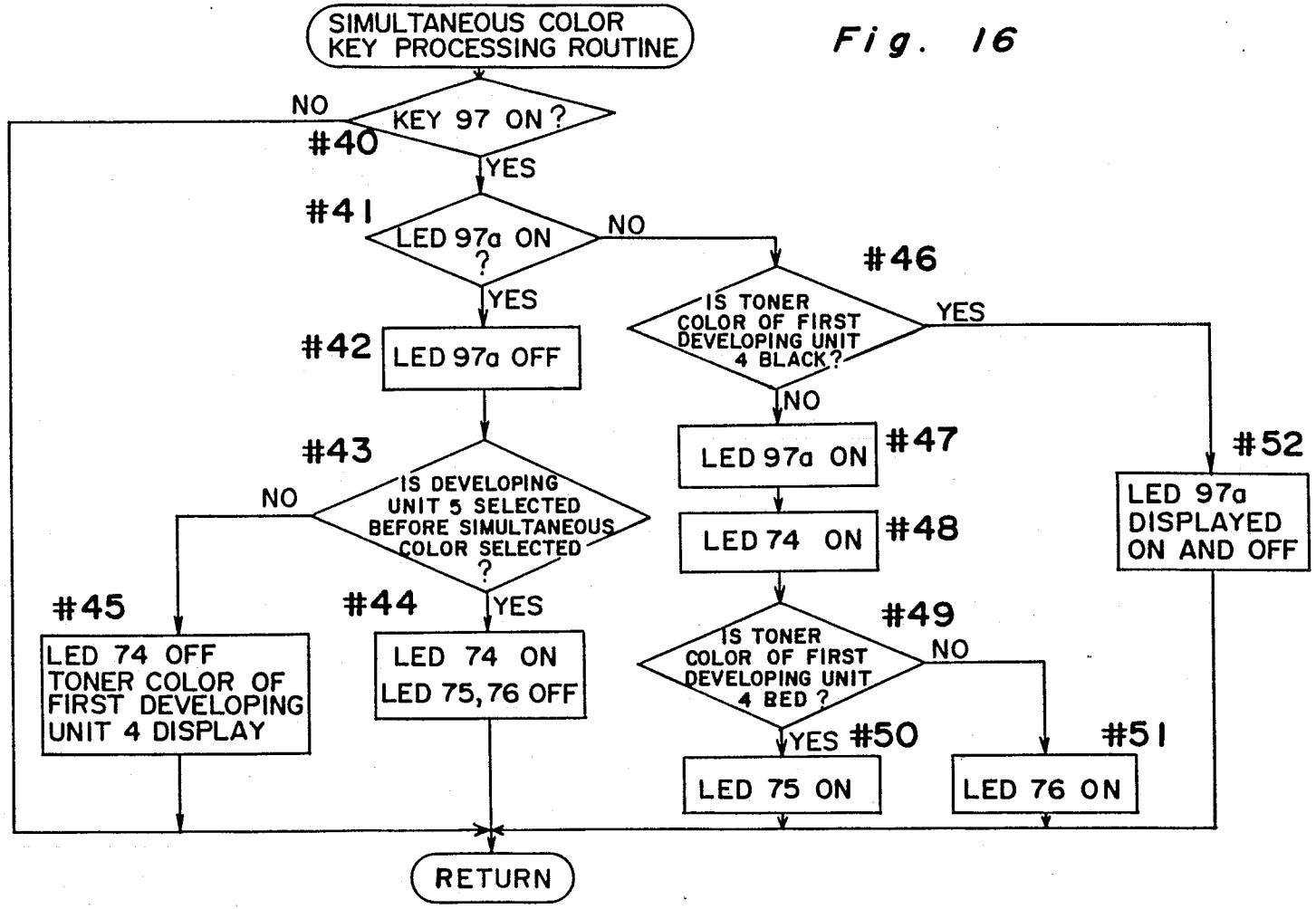

FIG. 16 shows a flow chart showing the simultaneous color key processing routine.

It is judged in step #40 whether or not the simultaneous color selecting key 97 is turned on, and in case of 'No', the program returns, and in case of 'Yes', the program goes to step #41 and it is judged whether the LED **97*a*** of the simultaneous color display unit is turned on or off.

In the case the LED **97*a* is turned on in step #41, the LED 97*a* is once turned off in the next step #42. Then, it is judged in step #43 whether or not the second developing unit 5 has been already selected before the simultaneous color selecting key 97 is turned on. In case of 'Yes', the program goes to step #44 so that the LED 74 for indicating black toner is turned on and the LED 75 for red toner or LED 76 for yellow toner is turned off. In case of 'No', the program goes to step #45 and the LED 74 for black toner is turned off so as to display the toner color of the first developing unit 4**.

The toner color of the first developing unit 4 is judged according to the color code table shown in FIG. 10 on the basis of the on/off signal of the switches SW1 and SW2, which is inputted to the control unit.

In the case it is judged in step #41 that the LED **97*a* is turned off, the program goes to step #46 and it is judged whether or not the toner color of the first developing unit 4 is black. In the case the toner color of the first developing unit 4 is black (in case of 'Yes' in step #46), since the toner color of the second developing unit 5 is also black, the simultaneous color development is prohibited so that the processing routines below step #47 are not performed. That is, the program goes to step #52 and the LED 97*a*** is turned on and off, thereby warning that the simultaneous color development is disabled.

In case of 'No' in step #46, the program goes to step #47 and the LED **97*a* is turned on in order to set the simultaneous color copy mode, and in the next step #48 the display unit LED 74** for black development is turned on, wherein the black is one of the two simultaneous color copy.

Next in step #49, it is judged, on the basis of the on/off signal inputted through the switches SW1 and SW2, whether or not the toner color of the first developing unit 4 is red, and in case of red, the program goes to step #50 and the display unit LED 75 for red development is turned on. On the contrary, in the case it is judged that the developing unit for yellow color containing yellow toner is attached as the first developing unit 4, the program goes to step #51 and the display unit LED 76 for yellow development is turned on.

That is, upon performing the processing routines in steps #46 to #52, in the case the developing unit 4 containing black toner is set, the simultaneous color copying operation is prohibited, and displays the warning that the simultaneous color copying operation is disabled and in the case the developing unit 4 containing red or yellow toner is set, it is displayed that the simultaneous color mode is selected and also the colors thereof are displayed.

Figures 17, 17A:
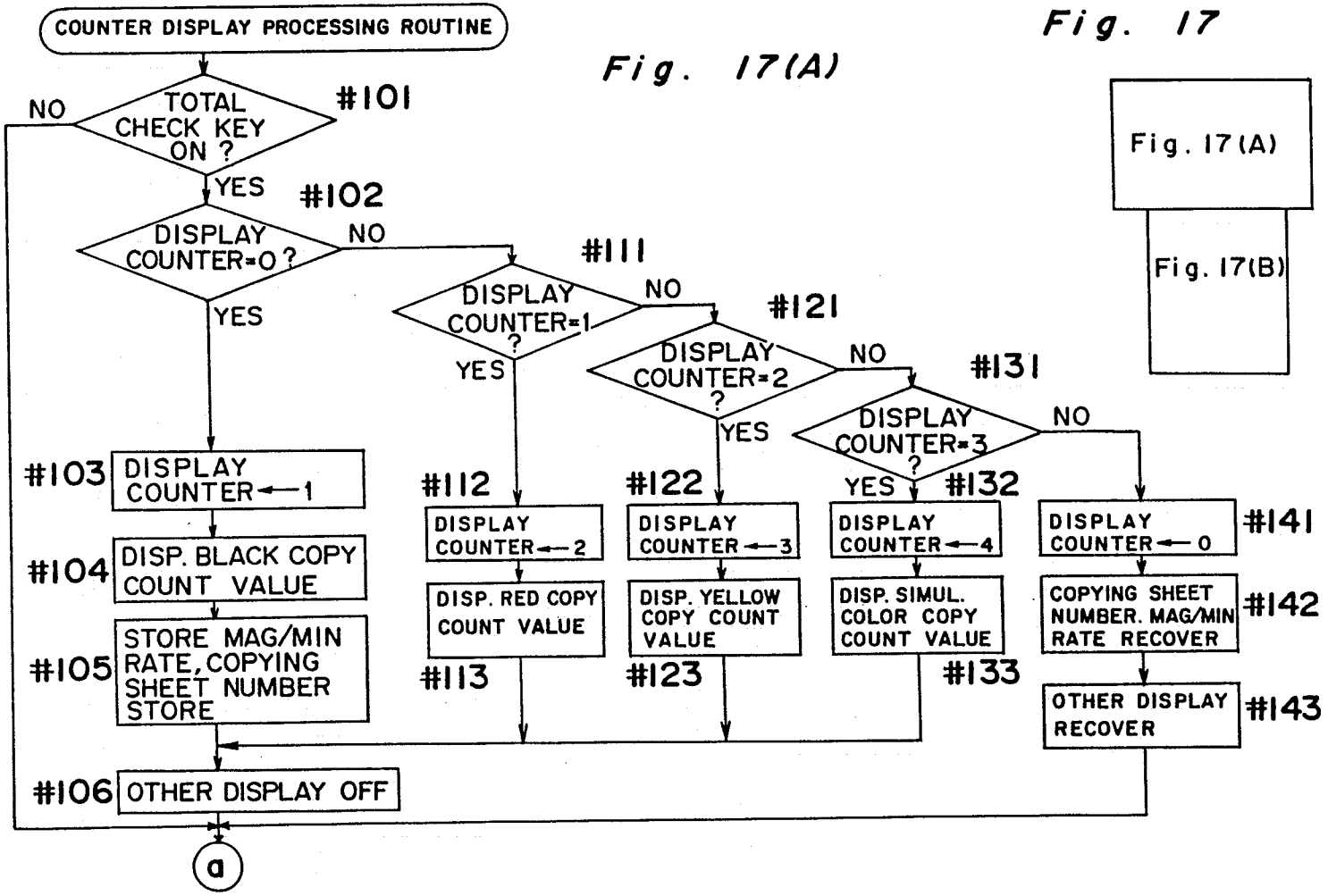
Figure 17:
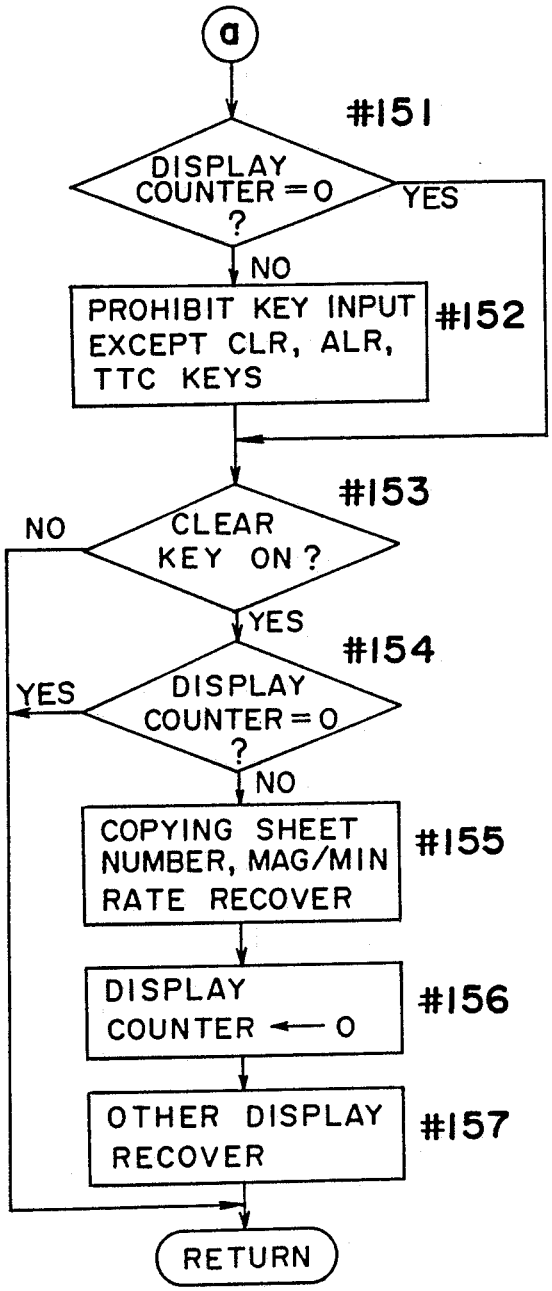

FIG. 17 shows a flow chart showing the counter display processing routine.

In step #101, in the case that the total check key 96 is turned on (in case of 'Yes'), the program goes to step #102 and the content of the display counter, which is displayed with three bits, is checked whether it is '0' or not. In the case the value of the display counter is '0', the MAG/MIN rate display unit LED 73 displays the copying MAG/MIN rate and the sheet number display unit LED 72 displays the number of copying sheets. In the case that the value of the display counter is '1' to '3', each of the values of the various kinds of counters is displayed in the LED 72 and LED 73 extendedly.

As shown in FIG. 13, in the case that the value of the display counter is '1', the most significant figure displays the character 'A' and the rest six figures display the count value of the black copying operation showing the number of the copying sheets with black toner. In the case that the value of the display counter is '2', the most significant figure displays the character 'b' and the rest six figures display the count value of the red copying operation using red toner showing the number of the copying sheets with red toner. In the case that the value of the display counter is '3', the most significant figure displays the character 'c' and the rest six figures display the count value of the yellow copying operation using yellow toner showing the number of the copying sheets with yellow toner. In the case that the value of the display counter is '4', the most significant figure displays the character 'd' and the rest six figures display the count value of the simultaneous color copying operation showing the number of the copying sheets with simultaneous color toner.

In the step #102, in the case the value of the display counter is '0' (i.e. in case of 'Yes' in the step #102), the value of the display counter is added by 1 in step #103, then the black copying count value using black toner is displayed in step #104, then the number of the copying sheets and the copying MAG/MIN rate, which have been previously displayed in the display units LED 72 and LED 73 are retired into a memory in step #105, and then all of the display units on the operation panel 70 except the display units LED 72 and LED 73 are turned off in step #106. Thus it becomes easy to read the display of the count value of the black copying operation with black toner.

On the other hand, in the case the value of the display counter is not '0' in the step #102 (i.e. in case of 'No' in step #102), the program goes to step #111 and it is judged whether or not the value of the display counter is '1', and in case of '1', the value of the display counter code is added by 1 in step #112, and the count value of the copying operation with red toner is displayed in step #113. In the similar way as described above, sequentially it is judged in step #121 whether or not the value of the display counter is '2', judged in step #131 whether or not the value of the display counter is '3', and in case of 'Yes', the values of the display counter are respectively increased one by one in steps #122 and #132, and then corresponding to the judged value of the display counter, the count value of the copying operation with yellow toner or the count value of the simultaneous color copying operation is displayed respectively in step #123 or #133.

In the case the value of the display counter is neither '0' to '3' when the total check key 96 is turned on, since the value of the display counter is '4', the value of the display counter is set '0' in step #141 and the number of the copying sheets and the copying MAG/MIN rate which have been previously retired into the memory are restored to be displayed in step #142, and at the same time the displays of other display units on the operation panel 70 are also recovered in step #143.

Next, in step #151 in the case the value of the display counter is not '0' (i.e. in case of 'No' in the step #151), the input operations of the keys other than the clearing stop key 91, the total check key 96 and the all reset key 98 are prohibited in step #152. Moreover, even though the various kinds of the count values are being displayed in step #154, when the clearing stop key 91 is turned on (in the case of 'Yes' in step #153), the copying MAG/MIN rate and the number of the copying sheets are recovered to be displayed in step #155, then the value of the display counter is set '0' in step #156 and the displays of the other display units on the operation panel 70 are also recovered in step #157.

Figure 18:
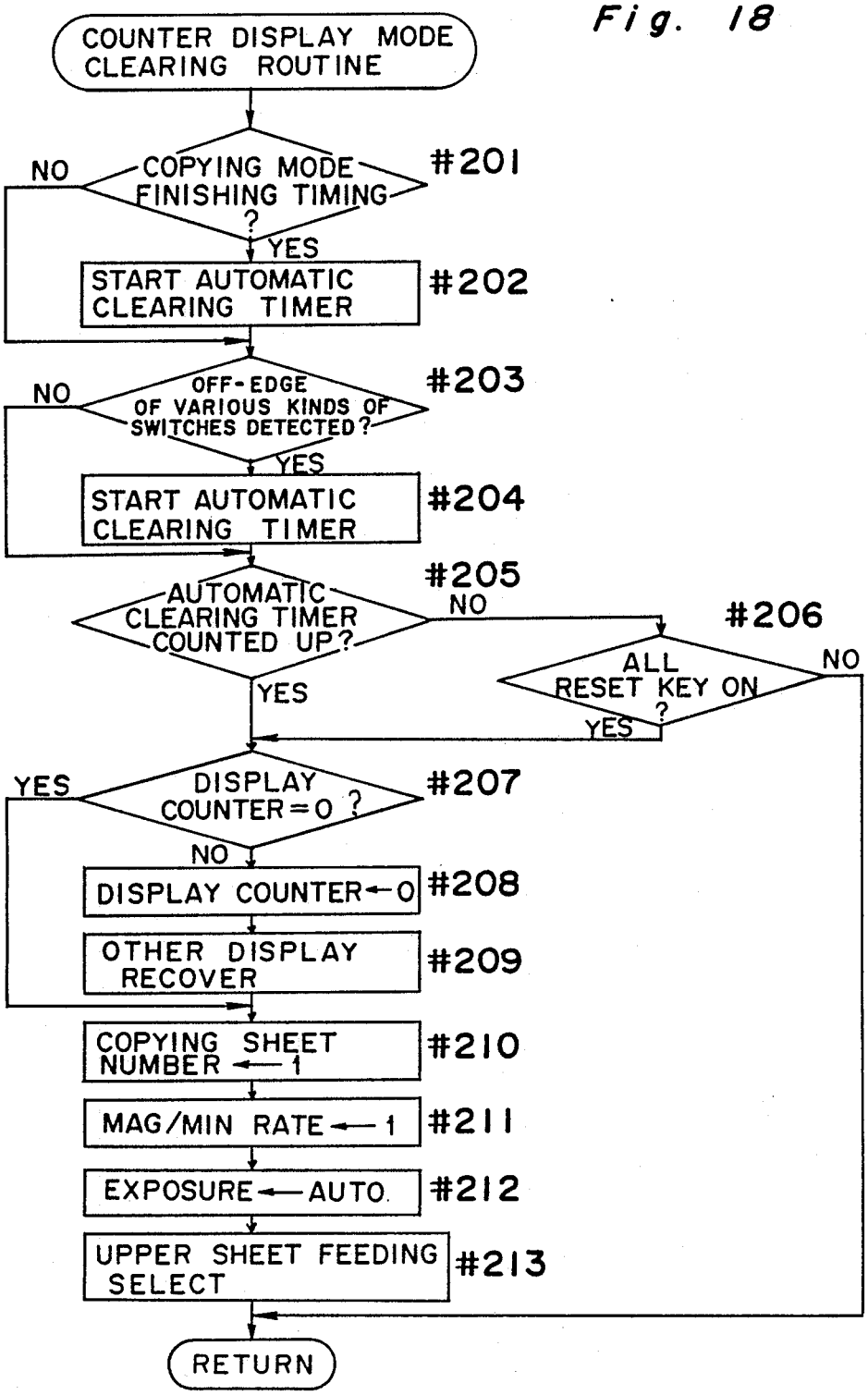

FIG. 18 shows a flow chart showing a counter display mode clearing routine.

When the signal representing the timing that of the copying mode is finished is detected in step #201 or the signal of the off-edge of the signals of the various kinds of the keys and switches on the operation panel 70 is detected in step #203 (i.e. in case of 'Yes' in step #201 or #203), the counting operation of the automatic clearing timer for resetting automatically is started in step #202 or #204.

Next, when the automatic clearing timer counts up (i.e. in case of 'Yes' in step #205) or when the all reset keys 98 are turned on (i.e. in case of 'Yes' in step #206), it is judged in step #207 whether or not the value of the display counter is set '0', and in the case the value of the display counter is not set '0' (i.e. in case of 'No' in the step #207), the value of the display counter is set '0' in step #208 and the other displays on the operation panel 70 are recovered in step #209.

Next in step #210, the number of the copying sheet is set '1' and the copying MAG/MIN rate is set to be equal in step #211, then the exposure operation is set in the automatic exposure in step #212 and the upper sheet feeding device 50 is selected in step #213 so as to set the various kinds of the copying conditions to be in the default values.

Figure 19:
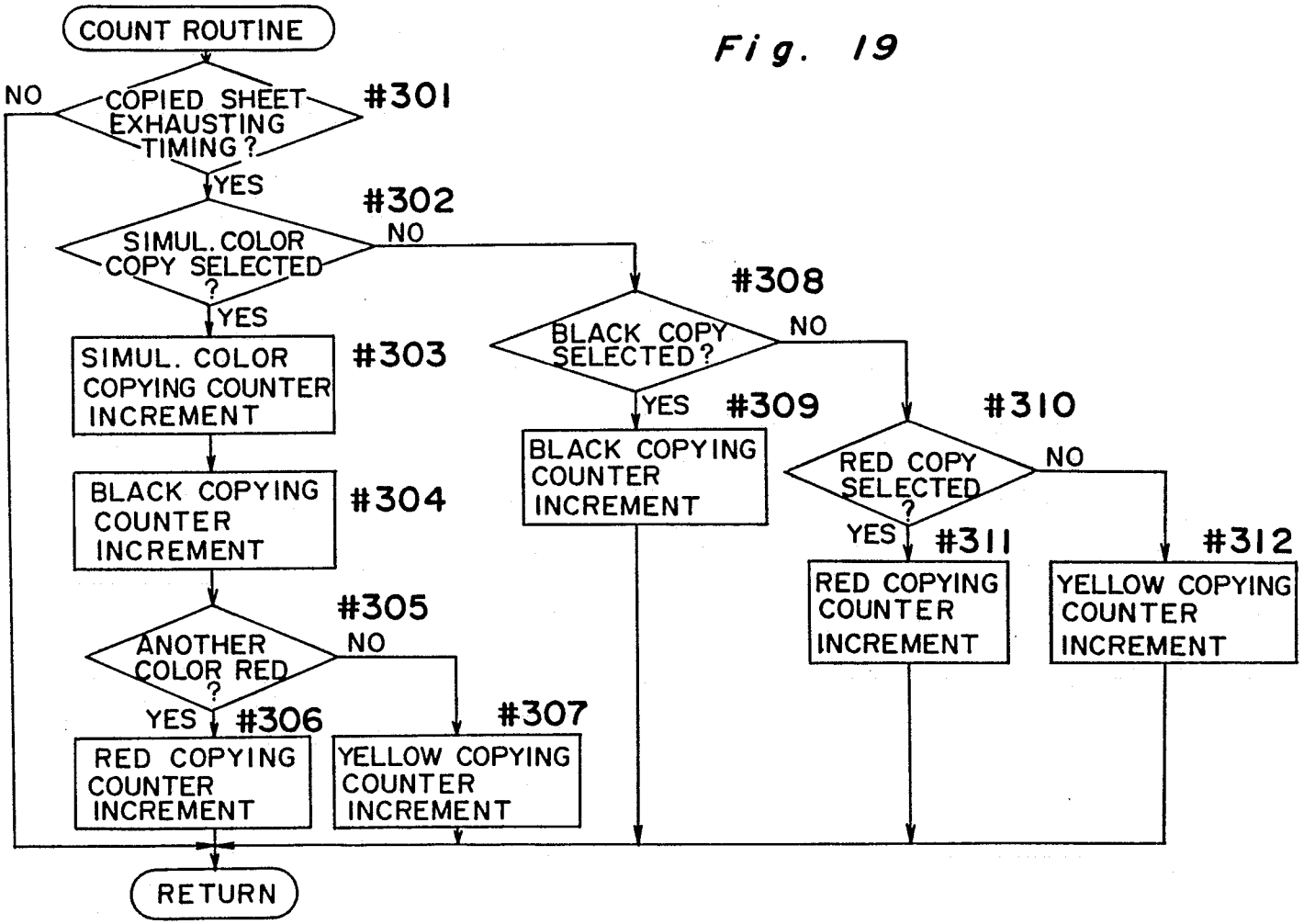

FIG. 19 shows a flow chart showing a count routine.

In the case the timing during which the copied sheet is discharged is set after finishing the copying operation onto the copying sheet (i.e. in the case of 'Yes' in step #301), it is judged in step #302 whether or not the simultaneous color copying mode is selected, and in the case the simultaneous color copying mode is not selected (i.e. in the case of 'No' in the step #302), the value of the copying counter corresponding to the color of the toner contained in the developing unit at that time is increased by 1 in steps #308 to #312.

In the case the simultaneous color copying mode is selected (i.e. in case of 'Yes' in the step #302), the values of the simultaneous color copying counter and the copying counter for black development are respectively increased by 1 in steps #303 and #304 and then the value of the copying counter for another color development judged in step #305 is increased by 1 in step #306 or #307.

In other words, in the case that the simultaneous color copying operation is executed, when the copying operation is finished and the copying sheet is fed out, the value of the simultaneous color copying counter is increased by 1 and the values of the two copying counters corresponding to the selected two kinds of toner colors. (one of the two colors is black) are respectively increased by 1.

According to the embodiment described above, the LED 73 for displaying the MAG/MIN rate with four figures and the LED 72 for displaying the number of copied sheets with three figures are integrally arranged in one display unit. Therefore, it is possible to display various kinds of count values with seven figures so that the count values can be displayed having the kind of the counter which is now in use displayed in the most significant figure without a problem of lacking of the display figures.

Moreover, since the copying operation is unnecessary at the time of displaying the various kinds of the counter values, the displaying operations of the other display units on the operation panel 70 are stopped (i.e. the display units LED are turned off), so that the lighting MAG/MIN rate display unit LED 73 and the lighting sheet number display unit LED 72 can be seen integratedly so as to read the display thereof very easily in spite of having some distance between the two display units LED 72 and LED 73.

Moreover, according to the embodiment described above, when the simultaneous color copying operation is executed, since the copying counter for simultaneous color copying operation and each of the copying counters corresponding to the selected two kinds of toner colors are respectively operated by counting, the operation time of each of the developing units containing respectively black, red or yellow toner can be obtained and the operated times of the simultaneous color copying operation and of the other usual copying operation can be distinguished each other, that may be of great advantage to the maintenance of the developing unit and the charge calculation in the copying machine.

In this embodiment, though the developing color of toner is changed in turn from black through red or yellow color to black again during one time scanning operation, the pattern of the color arrangement is not limited to this, and any image editing pattern can be made by changing the arrangement of the color developing units starting developing operation. Moreover, upon providing one lever, the developing color of toner may be changed only one time during the one time scanning operation, on the other hand, the number of the levers may be provided more than three.

In this embodiment, though the two developing units 4 and 5 are provided around the photoconductor drum 1 so as to enable to copy of two colors, in the present invention, three or four developing units may be provided around the photoconductor drum 1 so as to obtain three-colored or four-colored copy.

In the embodiment mentioned above, at the time of non-developing operation, although the developing motor 24 is stopped and the magnet roller 13 is rotated so as to. retire the magnet pole from the developing area X1 to the position opposing to the head control member 19, it is not essential to move the position of the magnet pole between in the developing operation and in the non-developing operation as described above. However, in the case that the magnet pole is moved as mentioned above, the probability that the magnetic brushes contacts with the photoconductor drum 1 can be lowered to prevent undesired mixture of the colors.

In this embodiment, though the developing unit containing black toner is always used as the second developing unit 5 and the developing unit containing red or yellow toner is selectively used as the first developing unit 4 in the copying machine, the present invention is not limited to this and any two kinds of the developing units among the three kinds of developing units containing black, red or yellow toner respectively may be selectively used as the first and second developing units 4 and 5 so that the two colored image of red and yellow, for example, may be formed.

In the embodiment mentioned above, though the platen 9 is fixed and the exposure lamp 41 is scanned, the present invention is not limited to this and the exposure lamp 41 may be fixed and the platen 9 may be scanned.

Furthermore, in the embodiment mentioned above, though the various kinds of the copying counters are operated on the basis of the program performed by CPU, an electronic counter or an electro-magnetic counter made by hard logic may be adopted.

In this embodiment, though the color copying operation is performed by switching the developing units containing toners of different colors in one scanning operation, the present invention is not limited to this and may be adopted to an ordinary color copying machine in which a plurality of developing units are provided and a colored image is obtained by plural times of scanning operations.

According to the present invention, when the simultaneous color copy is performed, the counter is so arranged as to count each operation of each developing unit during one copying operation, the number of operation time of each of the developing units can be respectively obtained. Therefore, the maintenance of the copying machine such as exchange and supply of the toner can be made timely and correctly based on the content of the counter. Also the rental charge calculation of the copying machine can be properly made based on the content of the counter in the simultaneous color copying operation.

What is claimed is:

1. A counting system in a copying machine comprising:

a platen for disposing an original document thereon, scan means for scanning the original document disposed on said platen;

a photoconductor for preserving an electrostatic latent image of the original document image scanned by said scan means on the surface thereof;

a developing station for developing the electrostatic latent image formed on the surface of the photoconductor, including first and second developing units containing different color developer respectively;

transfer means for transferring the image developed by said developing station from the photoconductor onto a copying sheet;

mode selecting means for selecting one of three modes including a first copying mode in which the electrostatic image formed on the surface of the photoconductor is developed by the first developing unit, a second copying mode in which the electrostatic latent image formed on the surface of the photoconductor is developed by the second developing unit and a third copying mode n which the electrostatic latent image formed on the surface of the photoconductor is developed by the first and the second developing units;

first processing means for applying power to the first developing unit so as to form a single colored copying image when the first copying mode is selected by said mode selecting means;

second processing means for applying power to the second developing unit so as to form a single colored copying image when the second copying mode is selected by said mode selecting means;

third processing means for applying power to the first and the second developing units so as to form a double colored copying image when the third copying mode is selected by said mode selecting means;

a first counter for determining a count value corresponding to the first developing unit;

a second counter for determining a count value corresponding to the second developing unit;

a third counter for counting the number of copying operations in the third copying mode to determine a count value; and counter control means for increasing the count value of the first counter every time a copying operation in the first copying mode is performed, for increasing the count value of the second counter every time a copying operation in the second copying mode is performed and for increasing the count values of the first, the second and the third counters every time a copying operation in the third copying mode is performed.

2. A counting system in a copy machine comprising:

a platen for disposing an original document thereon;

scan means for scanning the original document disposed on said platen;

a photoconductor for preserving an electrostatic latent image of the original document image scanned by said scan means on the surface thereof;

a developing station for developing the electrostatic latent image formed on the surface of the photoconductor, including first and second developing units containing different color developer respectively;

transfer means for transferring the image develop said developing station from the photoconductor onto a copying sheet;

mode selecting means for selecting one of three modes including a first copying mode in which the electrostatic image formed on the surface of the photoconductor is developed by the first developing unit, a second copying mode in which the electrostatic latent image formed on the surface of the photoconductor is developed by the second developing unit and a third copying mode in which the electrostatic latent image formed on the surface of the photoconductor is developed by the first and the second developing units;

first processing means for applying power to the first developing unit so as to form a single colored copying image when the first copying ;mode is selected by said mode selecting means;

second processing means for applying power to the second developing unit so as to form a single colored copying image when the second copying mode is selected by said mode selecting means;

third processing means for applying power to the first and the second developing units so as to form a double colored copying image when the third copying mode is selected by said mode selecting means;

a first counted for determining a count value corresponding to the first developing unit;

a second counter for determining a count value corresponding to the second developing unit;

a third counter for counting the number of copying operations in the third copying mode to determine a count value;

counter control means for increasing the count vale of the first counter every time a copying operation in the first copying mode is performed, for increasing the count values of the second counter every time a copying operation in the second copying mode is performed and for increasing the count values of the first and the second counter every time a copying operation in the third copying mode is performed; and wherein the copying machine further comprises indicating means for indicting a scanning area in the scanning direction of the original document to be scanned by the scan means and the third processing means switches the first and the second developing units to a power applied condition or to a power non-applied condition corresponding to the area indicated by the indicating means so as to form a double colored copying image during a one time copying operation of the scan means.

3. A counting system in a copy machine comprising:

a platen for disposing an original document thereon;

scan means for scanning the original document disposed on said platen;

a photoconductor for preserving an electrostatic latent image of the original document image scanned by said scan means on the surface thereof;

a developing station for developing the electrostatic latent image formed on the surface of the photoconductor, including first and second developing units containing different color developer respectively;

transfer means for transferring the image developed said developing station from the photoconductor onto a copying sheet;

mode selecting means for selecting one of three modes including a first copying mode in which the electrostatic latent image formed on the surface of the photoconductor is developed by the first developing unit, a second copying mode in which the electrostatic latent image formed on the surface of the photoconductor is developed by the second developing unit and a third copying mode in which the electrostatic latent image formed on the surface of the photoconductor is developed by the first and the second developing units;

first processing means for applying power to the first developing unit so as to form a single colored copying image when the first copying mode is selected by said mode selecting means;

second processing means for applying power to the second developing unit so as to form a single colored copying image when the second copying mode is selected by said mode selecting means;

third processing means for applying power to the first and the second developing units so as to form a double colored copying image when the third copying mode is selected by said mode selecting means;

a first counter for determining a count value corresponding to the first developing unit;

a second counter for determining a count value corresponding to the second developing unit;

a third counter for counting the number of copying operations in the third copying mode to determine a count value;

counter control means for increasing the count value the first counter every time a copying operation in the first copying mode is performed, for increasing the count value of the second counter every time copying operation in the second copying mode is performed and for increasing the count values of the first, the second, and the third counters every time a copying operation in the third copying mode is performed;

counter selecting means for selecting one of said first counter, second counter and third counter;

display means capable to displaying a numerical value of a decimal digit; and display control means for displaying the count value of the counter selected by the counter selecting means and a code number showing the short of the selected counter on a display unit.

4. A counting system in a copy machine comprising:

a platen for disposing an original document thereon;

scan means for scanning the original document disposed on said platen;

a photoconductor for preserving an electrostatic latent image of the original document image scanned by the scan means on the surface thereof;

a first developing means for developing the electrostatic latent image formed on the surface of the photoconductor with color developer contained in a first developing unit so as to form a visible image on the surface of the photoconductor under the operating condition thereof;

a second developing means for developing the electrostatic latent image formed on the surface of the photoconductor with color developer contained in a second developing unit so as to form a visible image on the surface of the photoconductor under the operating condition thereof;

indicating means for indicating a scanning area in a scanning direction of the original document to be scanned by the scan means;

processing means for switching the first and the second developing means into an operating condition or non-operating condition so as to form a double colored image in a one time scanning operation of the scan means on the basis of the area indicated by said indicating means;

a first counter whose count value is increased when the first developing means is operated;

a second counter whose count value is increased when the second developing means is operated; and a third counter whose count value is increased when a double colored image is formed in a one time scanning operation.

5. The counting system in the copying machine according to claim 4, wherein the copying machine further comprises:

display means capable of displaying a numerical value of a decimal digit;

counter selecting means for selecting either the first counter or the second counter; and display control means for displaying the count value of the counter selected by the counter selecting means and a code number showing the sort of the selected counter on a display unit.

6. A counting system in a copying machine comprising:

a platen for disposing an original document thereon;

exposure means for exposing the original document disposed on said platen;

a photoconductor for preserving an electrostatic latent image of the original document image exposed by said exposure means;

a developing station for developing the electrostatic latent image formed on the surface of the photoconductor, including a plurality of different kinds of developing units;

transfer means for transferring the image developed by said developing station onto a copying sheet;

mode selecting means for selecting any one of a plurality of copying modes;

processing means for selectively operating at least one developing unit on the basis of the copying mode selected by said mode selecting means so as to form a copying image;

detecting means for detecting the developing unit operated by said processing means;

wherein the plurality of copying modes comprise at least a first copying mode and a second copying mode and when the first copying mode is selected by the mode selecting means, the process means operates one of the developing units so as to form a copying image, and when the second copying mode is selected by the mode selecting means, the process means operates a plurality of the developing units during a single copying cycle so as to form a copying image;

a plurality of first counters, each of which determines a count value corresponding to one of said developing units;

a second counter for counting the number of copying operations in the second copying mode; and counter control means for operating the first counter corresponding to the developing unit detected by said detecting means during every copying operation and for operating the second counter during every copying operation in the second copy mode.

7. The counting system in the copying machine according to claim 6, wherein the copying machine comprises a mode counter for counting the number of copying operations in the second copying mode, and the counter control means operates said mode counter during every copy cycle in the second copying mode.

8. A counting system in a copying machine comprising:

a platen for disposing an original document thereon;

scan means for scanning the original document disposed on said platen;

a first developing unit for developing the electrostatic latent image formed on the surface of the photoconductor;

a second developing unit for developing the electrostatic latent image formed on the surface of the photoconductor, which is detachably attached to the copying machine;

transfer means for transferring a visible image developed by the first developing unit and/or the second developing unit from the surface of the photoconductor onto a copying sheet;

mode selecting means for selecting one of three modes including a first copying mode in which the electrostatic latent image on the surface of the photoconductor is developed by the first developing unit, a second copying mode in which the electrostatic latent image on the surface of the photoconductor is developed by the second developing unit and a third copying mode in which the electrostatic latent image on the surface of the photoconductor is developed by the first and the second developing units;

a first processing means for applying power to the first developing unit when the mode selecting means selects the first copying mode, thereby forming a copying image;

a second processing means for applying power to the first and the second developing units at different times during the one time scanning operation of the scan means when the mode selecting means selects the third copying mode, thereby forming a copying image;

detecting means for detecting the color of the developer contained in the second developing unit;

a first counter corresponding to the first developing unit;

a plurality of second counters corresponding respectively to the colors of the developer contained in the second developing unit; and counter control means for operating the first counter for every copying operation in the first copying mode, for operating the second counter corresponding to the color of the developer detected by the detecting means for every copying operation in the second copying mode and for operating the first counter and the second counter corresponding to the color of the developer detected by the detecting means for every copying operation in the third copying mode.

* * * * *